US005299733A

United States Patent [19]

Werth

[11] Patent Number: 5,299,733

[45] Date of Patent: Apr. 5, 1994

[54] DETACHABLE MULTI-UNIT PACKAGE WITH FLAP

[75] Inventor: Elmer D. Werth, Arvada, Colo.

[73] Assignee: Container Systems, Inc., Arvada, Colo.

[21] Appl. No.: 919,170

[22] Filed: Jul. 23, 1992

Related U.S. Application Data

[63] Continuation-in-part of Ser. No. 708,984, May 31, 1991, abandoned, which is a continuation-in-part of Ser. No. 629,251, Dec. 18, 1990, Pat. No. 5,249,738, which is a continuation-in-part of Ser. No. 538,834, Jun. 15, 1990, abandoned, which is a continuation-in-part of Ser. No. 510,173, Apr. 17, 1990, abandoned.

[51] Int. Cl.[5] ..... B65D 25/04

[52] U.S. Cl. ..... 229/120.011; 229/120.11; 229/235; 229/240

[58] Field of Search ..... 229/120.011, 120.11, 229/120.03, 120.17, 120.18, 40, 235, 240, 244; 206/140, 158, 192, 194, 434

[56] References Cited

U.S. PATENT DOCUMENTS

| | | | |
|---|---|---|---|
| 3,092,301 | 6/1963 | Selle | 229/120.011 |
| 3,677,458 | 7/1972 | Gosling | 229/120.011 |
| 3,785,545 | 1/1974 | Roussel | 229/120.011 |
| 4,913,291 | 4/1990 | Schuster | 229/120.011 |
| 4,917,290 | 4/1990 | Saiki et al. | 229/120.03 X |
| 4,919,269 | 4/1990 | Wright et al. | 229/120.011 |

*Primary Examiner*—Allan N. Shoap
*Assistant Examiner*—Christopher McDonald
*Attorney, Agent, or Firm*—James R. Young

[57] ABSTRACT

Disclosed is a package formed from a one-piece wrapper, typically made of carrier board, that is folded around twenty-four cans or bottles including a top and bottom of the package having cuts or perforations that partially separate the package into two twelve-packs; each side of the package having at least one tear-strip aligned with the cuts or perforations that will complete the separation into two twelve-packs; and the top of the package having a second pair of tear-strips which will allow the two twelve-packs to be separated into four six-packs. The wrapper can be folded in such a manner that the two six-packs of each of the two twelve-packs is separated by a center divider in the wrapper. This divider has a perforated top end which is aligned with the tear-strips. The two sides of the divider are held together by an adhesive which allows the six-packs to be separated. The combination of the tear-strips and the adhesive hold the container into a twenty four-pack, while easily allowing it to be divided into two twelve-packs, or four six-packs.

11 Claims, 18 Drawing Sheets

DETACHABLE MULTI-UNIT PACKAGE WITH FLAP

CROSS REFERENCE TO RELATED APPLICATIONS

This application is a continuation-in-part of application Ser. No. 07/708,984 filed May 31, 1991, now abandoned entitled "Detachable Multi-Unit Package with Flap", which is a continuation-in-part of application Ser. No. 07/629,251 filed Dec. 18, 1990, now U.S. Pat. No. 5,249,738, entitled "Detachable Multi-Unit Package", which is a continuation-in-part of application Ser. No. 07/538,834 filed Jun. 15, 1990, now abandoned, entitled "Detachable Multi-Unit Package", which is a continuation-in-part of application Ser. No. 07/510,173 filed Apr. 17, 1990, now abandoned, entitled "Detachable Multi-Unit Package".

BACKGROUND OF THE INVENTION

This invention relates to packaging a plurality of containers and more particularly to a package that can be separated into a plurality of packages. Even more particularly the invention relates to a one-piece wrapper made into a package for holding containers which can be easily separated into individual smaller packages upon delivery to the retailer, lowering the cost of manufacturing, warehousing, transportation, storage and delivery of containers.

Several different multi-unit packaging systems have been developed for the marketing of a number of packaged products, for example, bottled and canned beverages and other liquid products. Currently, most bottle or can containers are shipped in units of six, generally referred to as the six-pack package. Four six-packs are normally placed together in a paper tray for shipment from the manufacturer to the retail outlet. At present the six beverage containers in a six-pack are typically held together by a piece of plastic having six circular apertures or by a simple wrap-around paperboard package such as that disclosed in U.S. Pat. No. 4,566,593 issued Jan. 28, 1986 to Muller. When a paper tray of six-packs arrives at the retail outlet, the paper tray must be discarded if the containers are to be sold as six-packs. If the retailer would prefer to have two six-packs packaged together as a twelve-pack unit, or would prefer to sell six-packs individually, the manufacturer must establish a different manufacturing line to produce six-packs, twelve-packs, and twenty four-packs, and all manufacturing, warehousing, transportation, storage and delivery between the manufacturer and the retailer must store the six-packs, twelve-packs, and twenty four-packs separately.

U.S. Pat. No. 3,759,378, issued Sep. 18, 1973 to Werth, attempts to alleviate this problem by providing a container that will hold four six-packs. The container is comprised of a wrapper which wraps around all four six-packs, and has a tear-strip which allows the wrapper to be separated into two twelve-packs. A primary disadvantage of this type of package is that the tear-strip completely surrounds the entire carton, and therefore, the carton must be turned a full 360 degrees in order to remove the tear-strip.

U.S. Pat. No. 3,942,631 issued Mar. 9, 1976 to Sutherland, et al, also addresses the problem of separating containers after they arrive at the retailer. This invention, however, primarily addresses changing the outer carton which contains the six-packs into a display case.

U.S. Pat. No. 4,415,082 issued Nov. 15, 1983 to Martin, partially addresses the problem of shipping multi-unit cartons, each of which contains a liquid. A tear-strip is provided to separate the cartons and the outer wrapper is then used as a handle.

U.S. Pat. No. 2,758,777 issued Aug. 14, 1956 to Dixon, partially address the problem of shipping multi-unit cartons. Dixon, however, uses nearly double the quantity of material to form the packages as conventional packaging and this excess material, as well as being costly, significantly complicates the forming machinery necessary to assemble the packages at high speeds. The Dixon package requires a band to hold the packages together, since without the band, the bottom of the packages would separate. Thus the band serves the same function as the tray used with most conventional packages, and has the same cost and disposal problems. Also, once the band is removed, the package can only be separated into four six-packs and cannot be separated into twelve packs. Furthermore, the perforations separating the cartons would be difficult to break unless they are cut, thus increasing the complexity of the separation operation. Perforations are not very effective in packaging made of the heavy material necessary to hold twenty-four containers.

European Patent Application 0,029,365 Filed Nov. 14, 1980 addresses the problem of holding the containers in a package by forming apertures in the top of the package, but does not address the problem of multi-unit shipping.

None of the above described inventions address the primary problems associated with the current packaging methods. First, is the problem of requiring separate manufacturing lines and separate packaging, warehousing, transportation, storage and delivery in order to produce six-pack, twelve-pack and twenty four-pack packages. A second problem is the tray used to contain four six-packs: these trays are costly to produce, require added handling, produce unnecessary waste, and become a disposal problem. A third problem is having to dispose of the plastic six-pack carriers. Furthermore, none of the packaging methods described in the above patents address the easy separation of a package into four six-packs or two twelve-packs. There is need in the art then for a versatile package which is manufactured as a one-piece wrapper that holds a plurality of containers together as a single unit, and later can be separated by the retailer into two twelve-packs, or further separated by the retailer into four six-packs. There is also a need in the art for such a packaging method that would eliminate the cost, waste and disposal problems associated with the tray and plastic six-pack carriers presently used. There is further need in the art for a package wherein the wrapper that surrounds the twenty four-pack is the same wrapper surrounding the twelve-packs and six-packs, eliminating the need for any additional wrappers. Yet another need is for such a wrapper that eliminates or minimizes the use of perforations, because of the difficulty of separating heavy cardboard packages at the perforations.

SUMMARY OF THE INVENTION

It is an aspect of the present invention to provide a package formed from a single piece of material, capable of containing a plurality of containers such as cans or bottles.

It is another aspect of the invention to provide such a system that allows a manufacturer to eliminate separate manufacturing production for twenty four-pack, and twelve-pack.

Another aspect of the invention is to eliminate the need for separate warehousing, transportation, storage and delivery of twenty four-pack, and twelve-pack packages.

A further aspect of the invention is to provide such a package that can be conveniently separated into two twelve-pack containers.

A still further aspect of the invention is to provide such a container which is formed from a piece of carrier board, recycled paper or other recycled materials, or from A, B, C, D, E, or Super E flute paper corrugated material.

The above and other aspects of the invention are accomplished with a package formed from a wrapper, typically made of a single piece of carrier board, that is folded around a desired number of containers such as twenty-four cans or bottles. The top of the package has a cut or perforation that partially separates the package into two twelve-packs. Each side of the package has a foldover flap with a tear-strip that will complete the separation of the package into two twelve-packs, for example, without having to lift and rotate the package.

Another embodiment of the invention contains a pair of end flaps, each containing a tear strip, that overlap from one half of the package to the other. A pair of center flaps fold between two twelve packs within the package. A cut or perforation separates the center flaps, and this cut or perforation is aligned with the tear strips to allow easy separation of the package into two packs.

BRIEF DESCRIPTION OF THE DRAWINGS

The above and other objects, features, and advantages of the invention will be better understood by reading the following more particular description of the invention, presented in conjunction with the following drawings, wherein.

DESCRIPTION OF THE PREFERRED EMBODIMENT

The following description is of the best presently contemplated mode of carrying out the present invention. This description is not to be taken in a limiting sense but is made merely for the purpose of describing the general principles of the invention. The scope of the invention should be determined by referencing the appended claims.

Figure 1:
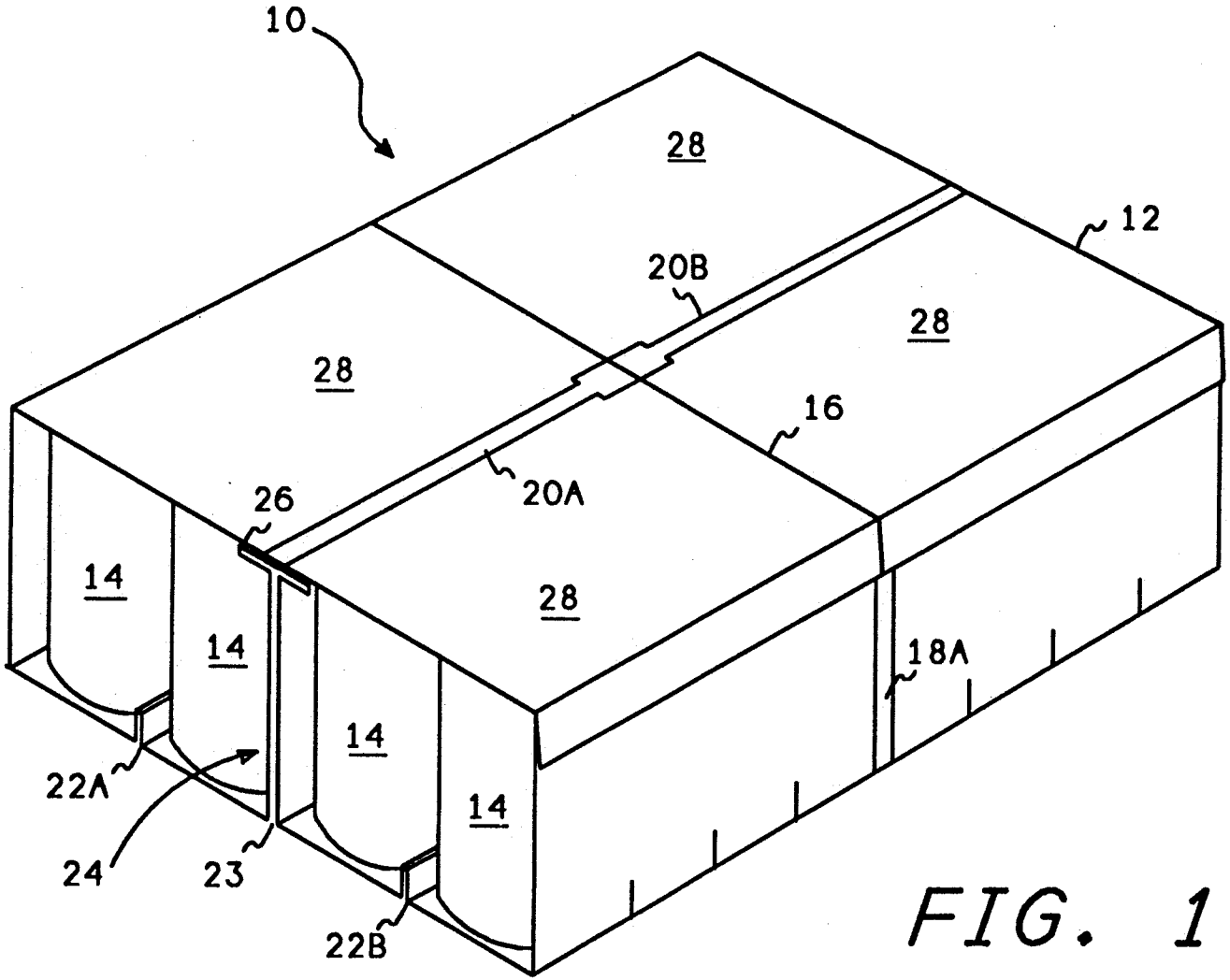
FIG. 1 shows a perspective view of the detachable multi-unit package.

FIG. 1 shows a perspective view of the multi-unit package of the present invention. Referring now to FIG. 1, a package 10 is comprised of a One-piece wrapper 12 which wraps around and contains twenty-four cans or bottles 14, arranged in four rows of six. The wrapper 12 has a cut 16 in the package top 28 and a cut (not shown in FIG. 1) in the package bottom which, in combination with a pair of tear-strips 18A and 18B (not shown in FIG. 1), allow the twenty four-pack to be split into two twelve-packs. Cut 16 need not extend completely across top 28, but preferably should extend far enough to weaken the line between tear-strips 18A and 18B so the package can be separated with relative ease. Cut 16 and the portion of cut 50 located on the package bottom (shown in FIG. 5) together with tear-strips 18A and 18B, form a wrap-around dimension of the package. A second pair of tear strips 20A and 20B allow the two twelve-packs to be split into four six-packs. A pair of folds 22A and 22B, formed as part of the one-piece wrapper 12, separate the rows of cans or bottles to provide cushioning and to assist in keeping the cans or bottles inside the wrapper 12. A center divider 24, also formed as part of the one-piece wrapper 12 by making a fold open at 23, contains a foldover flap 26 located at the top end of the divider 24. The foldover 26 allows the divider 24 to be glued to the top 28 of the wrapper 12, as illustrated in FIG. 4. The foldover 26 (shown in greater detail in FIG. 3) contains a perforation at its center to allow a twelve-pack to be easily separated into two six-packs once tear-strips 20A and 20B are removed. The divider 24, as part of being formed from the one-piece wrapper 12, contains two side pieces which are attached together. The attachment means used to hold the side pieces together is of a type that will allow the side pieces to be pulled apart with relative ease to form the six-packs.

In another embodiment (not shown), the center divider 24 does not extend to contact the top 28 but, instead, is the same height as the folds 22A and 22B.

The package of the invention is easily adaptable for (1) holding greater or less than twenty-four containers, and (2) producing sub-units of other than six containers such as eight-packs or four-packs. A divider (such as 24 in FIG. 1 or 66 in FIG. 8) need not be centrally located, but may be located between any desired subset of the total number of containers held in the package. For example, in a twenty-four-pack package, two dividers 24 could be positioned to form a six-pack (one row of six) on either side of a centrally located twelve-pack (two rows of six). One can see that the package and method of packaging containers of the invention is very adaptable for producing a variety of desired package combinations.

Figure 2:
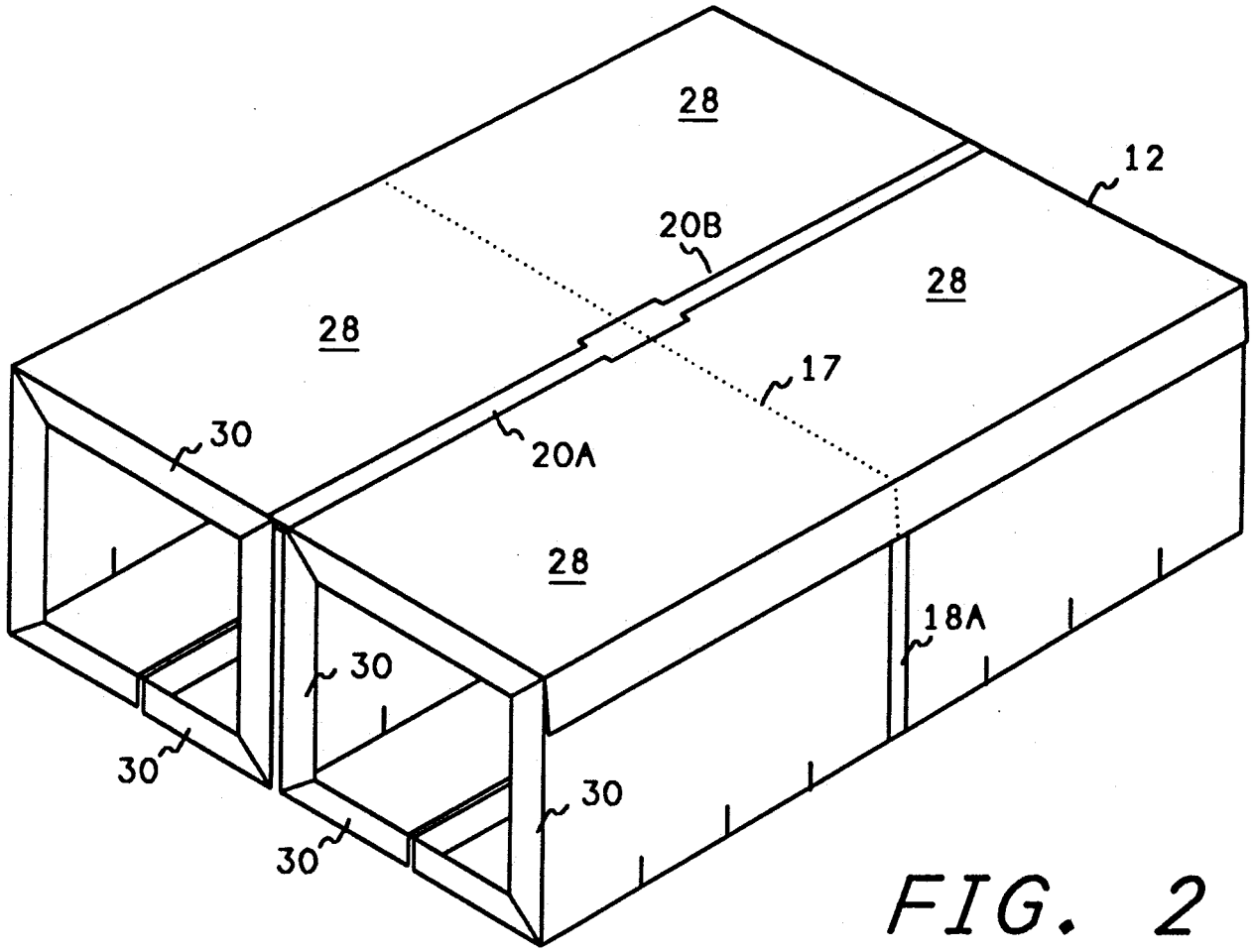
FIG. 2 shows an alternative embodiment of the package showing end flaps.

FIG. 2 shows a second embodiment of the invention. Referring now to FIG. 2, a series of end-flaps 30 may be incorporated into the package along its side edges (as shown also in FIG. 6) to assist in retaining the cans or bottles inside the wrapper 12. Perforation 17 in top 28 extends along a line connecting 18A and 18B (not shown in FIG. 2). Once tear-strips 18A and 18B are removed, the package can be torn apart along perforations 17 and 31 (shown in FIG. 6).

Figure 3:
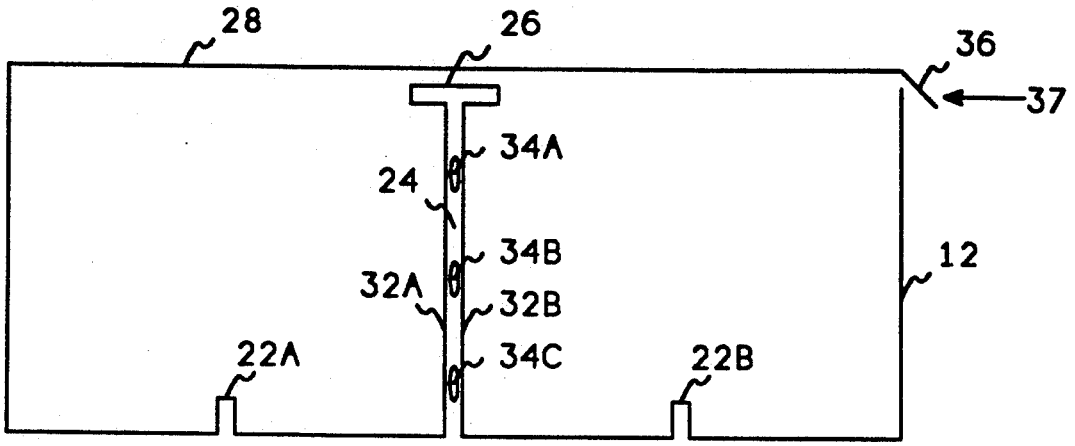
FIG. 3 shows an end view of the package.
Figure 4:
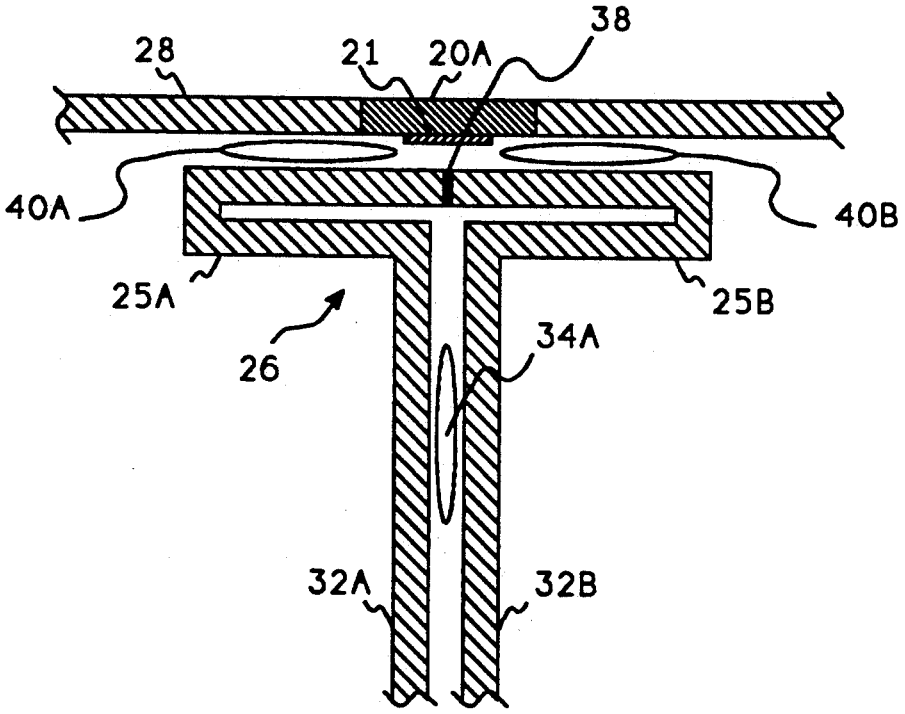
FIG. 4 shows an end view of the connection between the center divider and the top of the package.

FIG. 3 shows an end view of the package 10. Referring now to FIG. 3, the one-piece wrapper 12 is shown having the folds 22A and 22B and the center divider 24. The center divider 24 is shown having two side pieces 32A and 32B which form the sides of two six-packs after the unit is separated. Beads of adhesive 34A, 34B, and 34C extend sufficiently far along divider 24 to hold the two six-packs together until separation is desired. A flap 36 located at trailing edge portion 37 is used to secure the wrapper around the containers after the twenty-four cans or bottles have been wrapped.

Other methods can be used to hold the package together in place of the adhesive 34A, 34B, and 34C. For example, ultra sonic welding, laser welding, flame welding, tape, staples, or rivets could be used.

FIG. 4 shows a detailed view of the foldover flap 26 as it makes contact with the package top 28. Referring now to FIG. 4, center divider sides 32A and 32B are folded to produce the foldover flap 26. At the center of the foldover flap 26 is a perforation 38 which extends sufficiently far along the length of the divider to allow the package to be split into six-packs and is aligned with the second pair of tear-strips 20A and 20B. Foldover flap 26 has a first and second ear 25A and 25B located on opposite sides of perforation 38. The tear-strip 20A is shown centered over the perforation 38. The ears 25A and 25B of foldover flap 26 are attached to the top 28 of the wrapper by a pair of beads of adhesive 40A and 40B which extend sufficiently far along divider 24 to hold the six-pack sub-units together. After the tear-strips 20A and 20B are removed from the package, the divider is separated at perforation 38 and the adhesive beads 34A, 34B, and 34C can be pulled away to allow the twelve-pack to be separated into two six-packs. A tear-strip such as 18A, 18B, 20A, 20B, 73A and 73B of FIG. 10, and 83A and 83B of FIG. 11 can take many suitable forms such as (1) two parallel perforations in the wrapper with or without pull string 21 of FIG. 4 to aid in separating the tear-strip from the wrapper, or (2) an adhesive-backed strip or flexible, strong plastic placed over a cut in the wrapper where the tear-strip is to be located.

Figure 5:
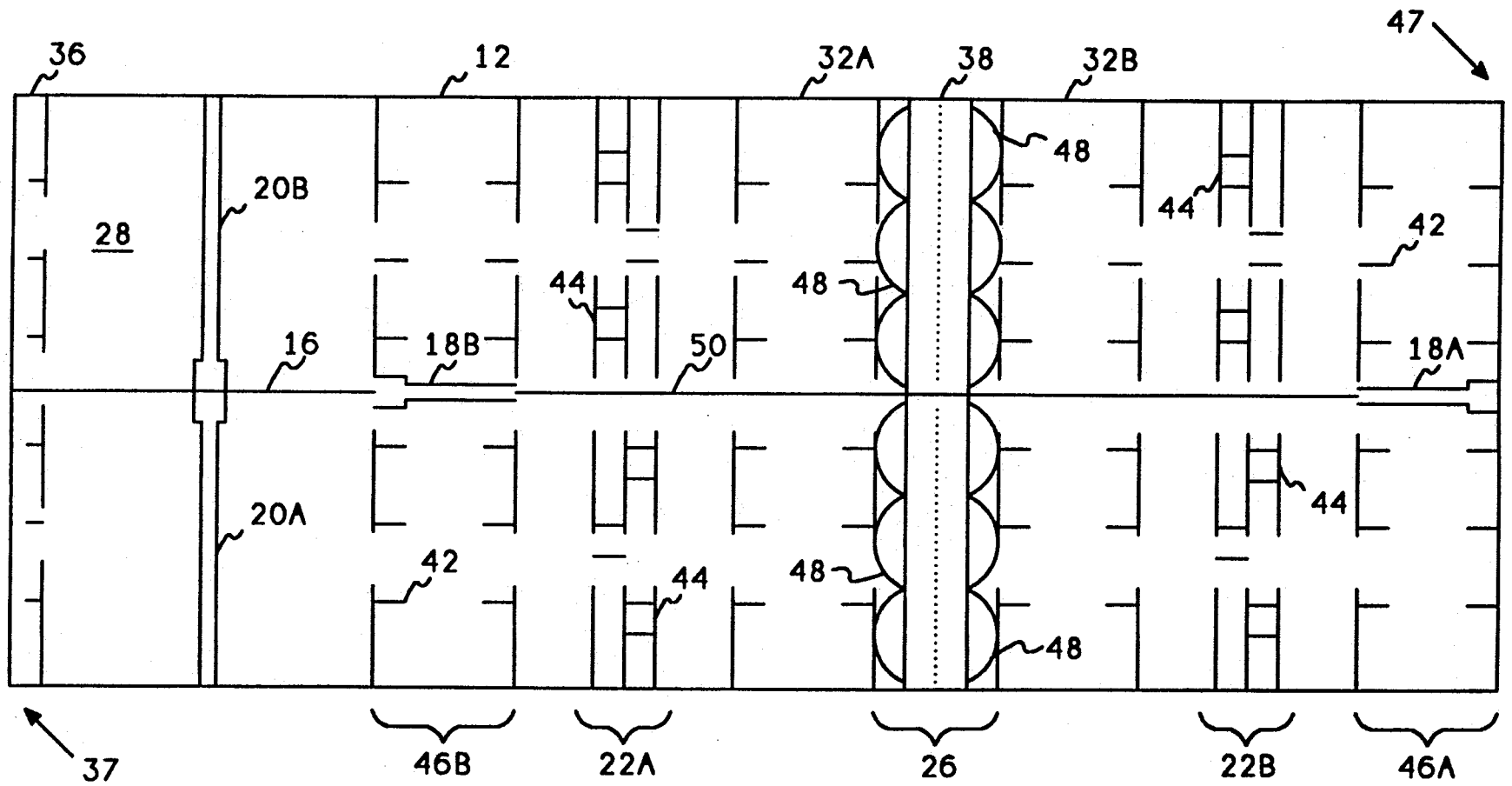
FIG. 5 shows a layout view of the one-piece construction used to form the package.

FIG. 5 shows a lay-out view of the wrapper 12. Referring now to FIG. 5, the wrapper 12 includes a leading edge portion 47 and on end flap 36 located at trailing edge portion 37. The top section 28 is shown having the tear-strips 20A and 20B, as well as the cut 16. Side tear-strips 18A and 18B are shown in the side sections 46A and 46B. Folds 22A and 22B are shown having cutouts 44 which assist in retaining the cans or bottles in the package 10. Divider side pieces 32A and 32B, as well as side pieces 46A and 46B contain slits 42 which also assist in retaining the cans or bottles in the container 10. Semi-circular scallops 48 formed into the first and second ears of foldover flap 26 assist in retaining the cans or bottles inside the carton. Scallops 48 are cut to fit the containers. A cut 50, located in the bottom of the package along a line connecting first-pair tear-strips 18A and 18B, is aligned with cut 16 located in the top of the package. Cuts 50, 16 sufficiently weaken the package to allow it to be separated into two twelve-packs. Thus, preferably the tear-strips 18A and 18B are the primary means used to hold the two twelve-packs together. This is advantageous, because the tear-strips 18A and 18B can be removed without turning the carton over, unlike prior art devices.

Cuts 16 and 50 together with tear-strips 18A and 18B form a lengthwise dimension of the wrapper extending from leading edge portion 47 to trailing edge portion 37.

The method of packaging the containers 14 of FIGS. 1-5 includes: providing wrapper 12 with tear-strips 18A and 18B spaced apart along a first-pair line (see cut 50 of FIG. 5) between tear-strips 18A and 18B; cutting a portion of the wrapper 12 along the first-pair line at 50 in FIG. 5; and wrapping the wrapper 12 around containers 14 and securing at least a portion of trailing edge portion 3 in FIG. 5 to the wrapper so that tear-strips 18A and 18B are located on package side pieces 46A and 46B. A portion of cut 50 will be located on the package bottom. The method of packaging can further include cutting wrapper 12 between tear-strip 18B and trailing edge portion 37 to further weaken the wrapper along the first-pair line. This forms cut 16 located on package top 28 as shown in FIGS. 1 and 5.

Figure 6:
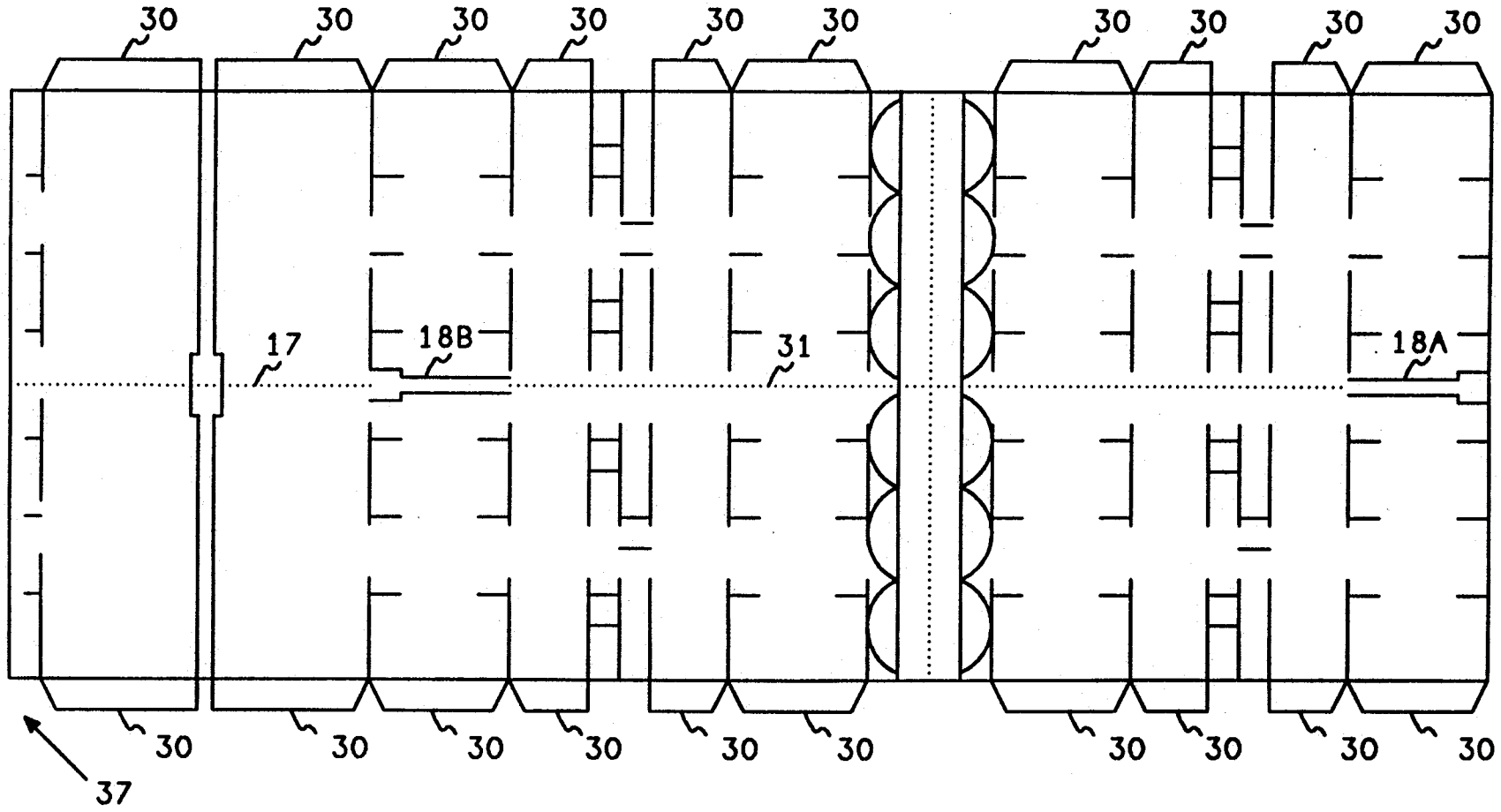
FIG. 6 shows a layout view of the alternative embodiment.

FIG. 6 shows a lay-out view of the alternative embodiment of FIG. 2. Referring now to FIG. 6, the lay-out is similar to the lay-out of FIG. 5, with the addition of the series of end flaps 30 which assist in retaining the cans or bottles inside the package 10. Alternatively, perforation 31 which extends along a line connecting tear-strips 18A and 18B could be a combination of a perforation in the portion of the wrapper that becomes the package bottom plus cuts along the same line. It is only important that the line connecting tear-strips 18A and 18B sufficiently weaken the package to allow it to be separated along that line with relative ease.

Figure 7:
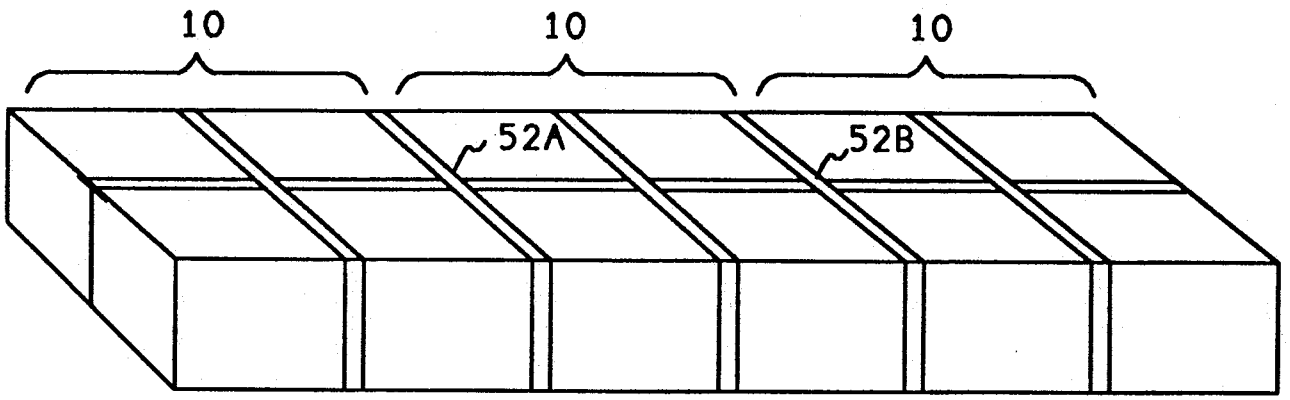
FIG. 7 shows a plurality of packages connected together.

FIG. 7 shows three of the packages 10 integrated together end to end to form a seventy two-pack. This package is formed of a one-piece wrapper that integrates three packages 10 by adding third and fourth tear-strips or a third and fourth combination of tear-strips plus cuts (similar to the combination in FIG. 1 of tear-strips 18A and 18B plus cuts 16 and 50) as shown at 52A and 52B which can be used to separate the unit into three twenty four-packs.

Figure 8:
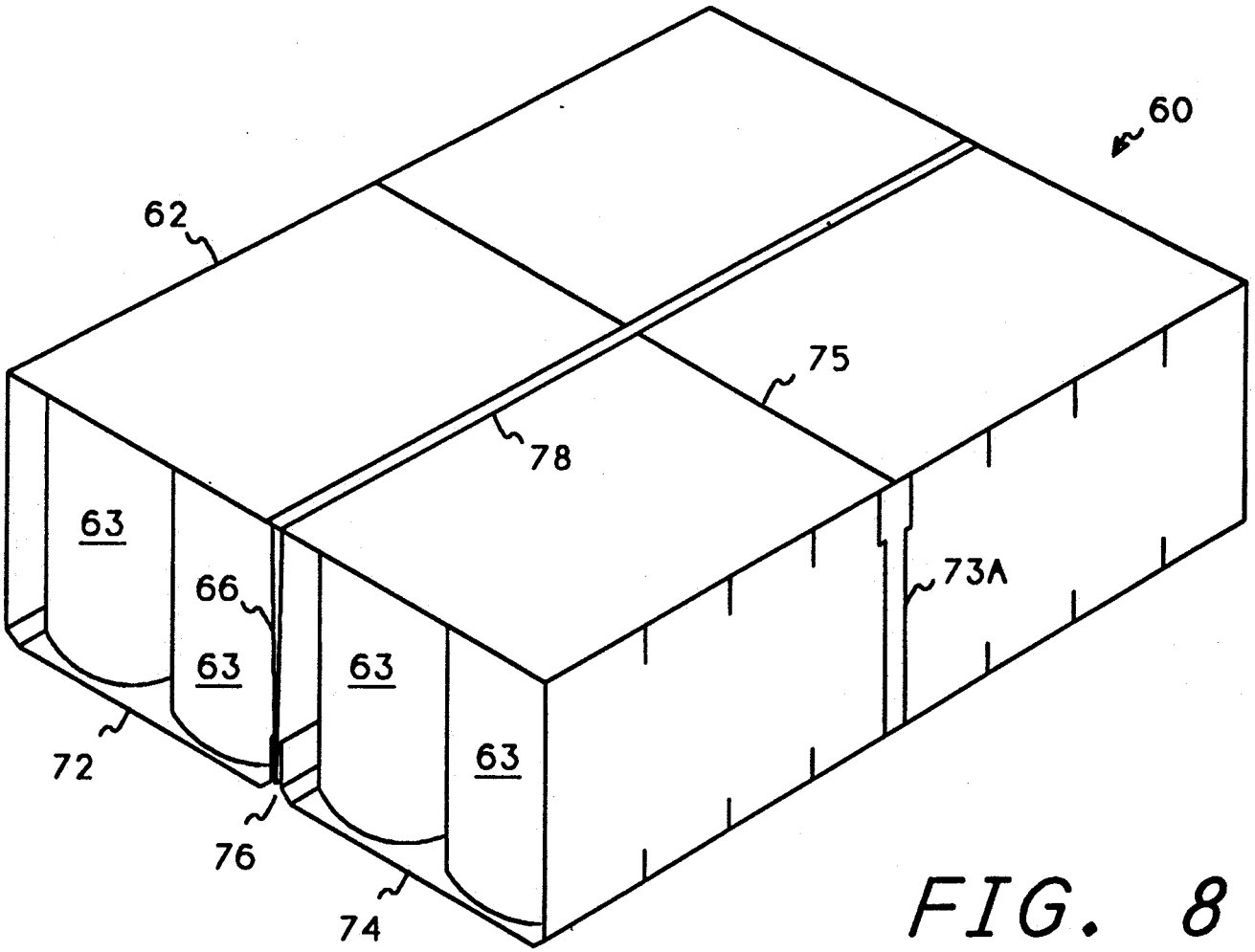
FIG. 8 shows a perspective view of a second alternative embodiment of the invention.
Figure 10:
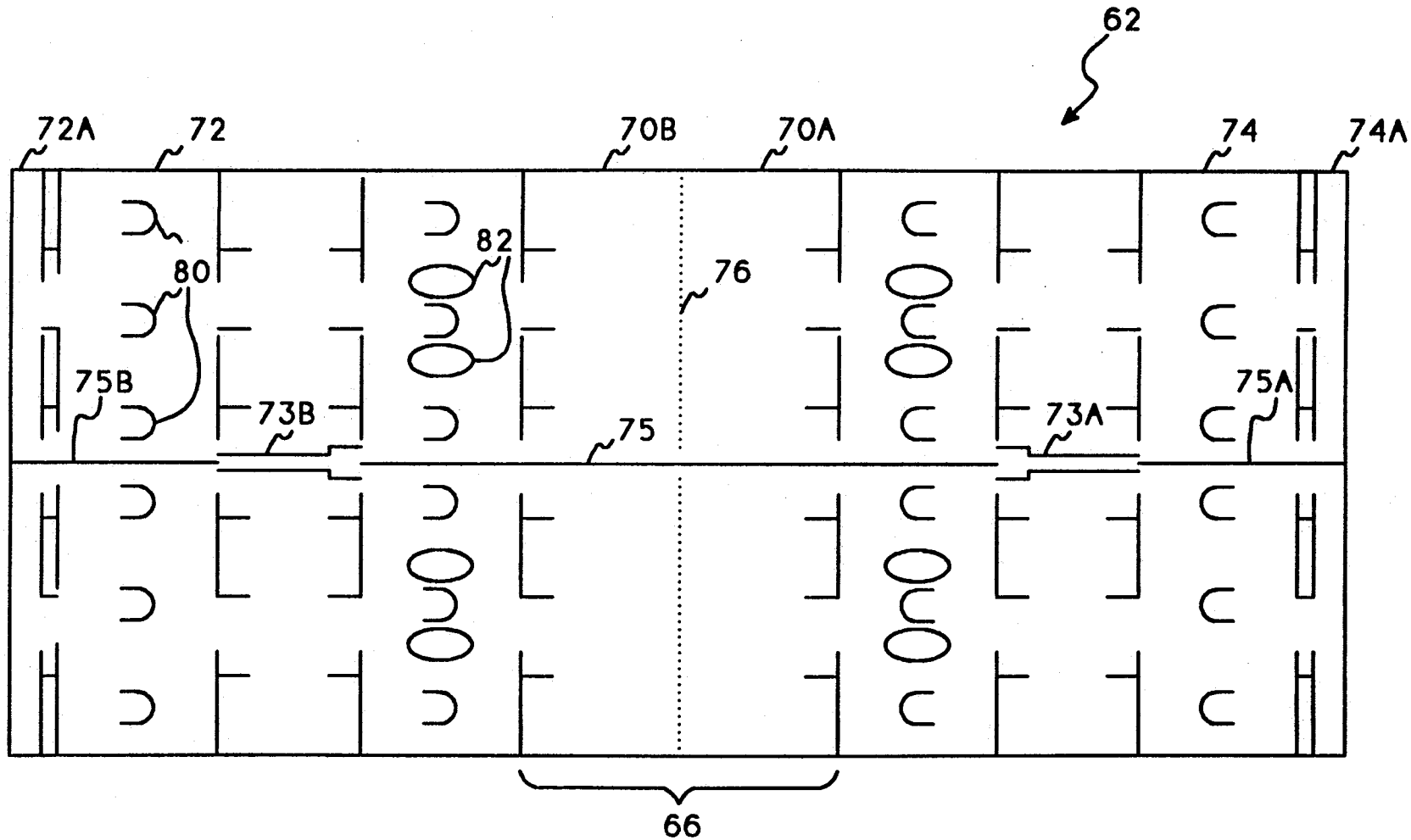
FIG. 10 shows a layout view of the second alternative embodiment.

FIG. 8 shows a perspective view of an alternative embodiment of the package. Referring now to FIG. 8, a package 60 is comprised of a one-piece wrapper 62 which wraps around and contains twenty-four cans or bottles 63, which are arranged in four rows of six cans or bottles. The wrapper 62 has tear-strips 73A and 73B (as shown in FIG. 10) and cuts 75, 75A and 75B (FIG. 10) which allow the twenty-four-pack to be split into two twelve-packs. A center divider 66 is also formed as part of the one-piece wrapper 62. The center divider 66 contains a perforation at its top end 76 to allow each twelve-pack to be easily separated into two six-packs. The divider 66, as part of being formed from the one-piece wrapper 62, contains two side pieces which are attached together. The attachment means used to hold the side pieces together is of a type that will allow the side pieces to be pulled apart with relative ease to form the six-packs. A strip of tape 78 optionally can be used for increased resistance to premature separation.

Figure 9:
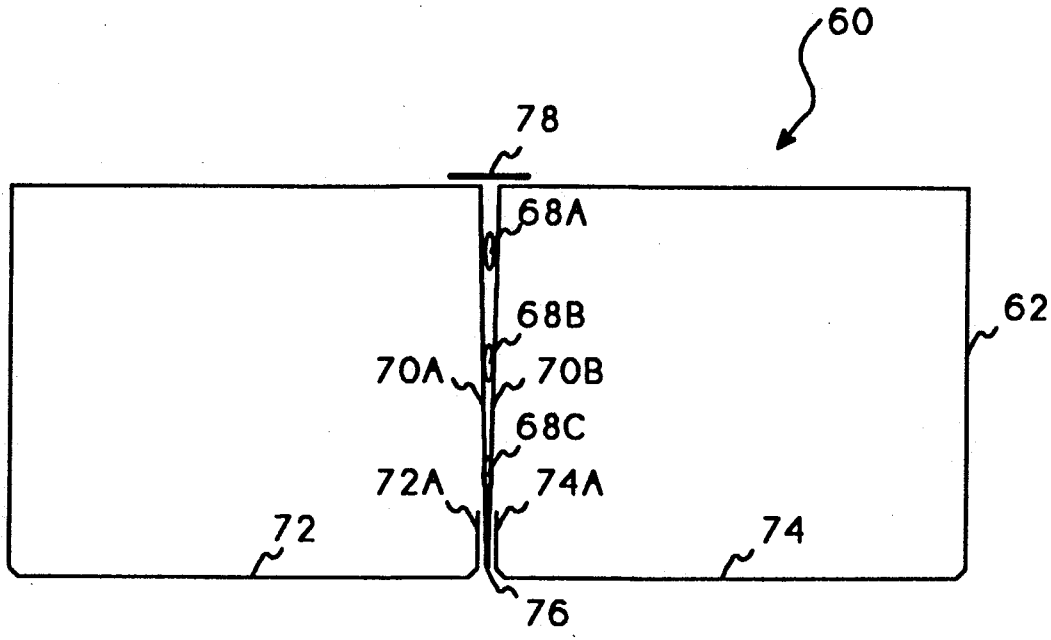
FIG. 9 shows an end view of the second alternative embodiment.

FIG. 9 shows an end view of the package 60. Referring now to FIG. 9, the one-piece wrapper 62 is shown with the center divider 66 having two side pieces 70A and 70B which form the sides of six-packs after the unit is separated. Beads of adhesive 68A, 68B, and 68C or other suitable attachment means extending sufficiently far along divider 66, hold the two six-packs together until separation is desired. The bottom of the container is formed by two flaps 72 and 74, which have trailing edge portion 72A and leading edge portion 74A that are secured by suitable means to the center divider 66 to form a closed container. Center divider 66 is perforated along its top end (shown as dotted line 76 in FIG. 10), so that the two six packs can be easily separated.

The two flaps 72 and 74 may be folded to provide a "v" shaped opening at the center bottom of the package. This also requires that divider 66 be shortened so that it does not extend into the opening. This "v" shaped opening allows the package halves to be more easily grasped for package separation. When used in this manner, the package may be inverted so that the "v" shaped opening is in the top of the package.

Other methods can be used to hold the packages together, in place of the adhesive 68A, 68B, and 68C. For example, ultra sonic welding, laser welding, flame welding, tape, staples, or rivets could be used.

FIG. 10 shows a layout view of the wrapper 62. Referring now to FIG. 10, each of the sections of the wrapper described above is shown. Partial cutouts 80 are folded up at approximately 90 degrees to the package top or bottom in which they lie, so that partial cutout 80 projections are formed and they are located between the cans or bottles to help keep the cans inside the container. Partial cutouts 82 serve as finger holes so that a person can hold a six-pack.

Figure 11:
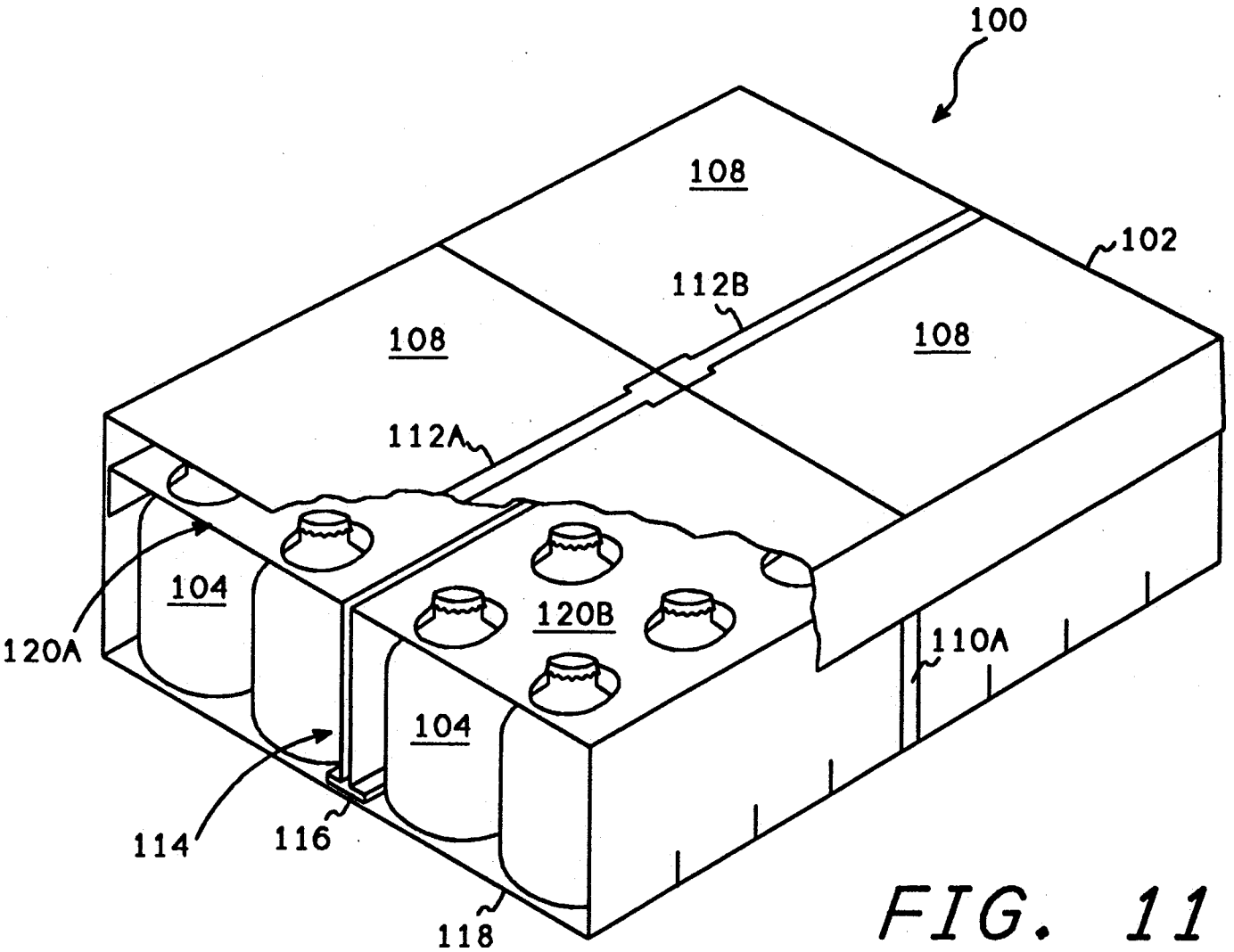
FIG. 11 shows an alternative embodiment of the invention having a container retaining panel.

FIG. 11 illustrates another alternative embodiment wherein cutouts are provided in a container retaining panel to assist in retaining containers within a package. Referring now to FIG. 11, a package 100 is comprised of a one-piece wrapper 102 which wraps around and contains twenty-four cans or bottles 104, arranged in four rows of six. The wrapper 102 has a cut 106 in the package top 108 and a cut (not shown in FIG. 11) in the package bottom which, in combination with a pair of tear-strips 110A and 110B (not shown in FIG. 11), allow the twenty four-pack to be split into two twelve-packs. Cut 106 need not extend completely across top 108, but preferably should extend far enough to weaken the line between tear-strips 110A and 110B so the package can be separated with relative ease. Cut 106 and the portion of the cut located on the package bottom (not shown in FIG. 11) together with tear-strips 110A and 110B, form a wrap-around dimension of the package. A second pair of tear strips 112A and 112B allow the two twelve-packs to be split into four six-packs. A center divider 114, also formed as part of the one-piece wrapper 102, contains a foldover flap 116 located at the bottom end of the divider 114. The foldover 116 allows the divider 114 to be glued to the bottom 118 of the wrapper 102. The bottom 118 contains a cut or perforation (not shown in the figure) at the glue point. The divider 114, as part of being formed from the one-piece wrapper 102, contains two side pieces which are attached together. The attachment means used to hold the side pieces together is of a type that will allow the side pieces to be pulled apart with relative ease to form the six-packs.

A pair of container retaining panels 120A and 120B contain a plurality of cutouts 122, one for each container 104, which allow the top of a container 104 to protrude therethrough while fitting snugly around the container 104. These cutouts assist in retaining the containers 104 in the package 100.

Figure 12:
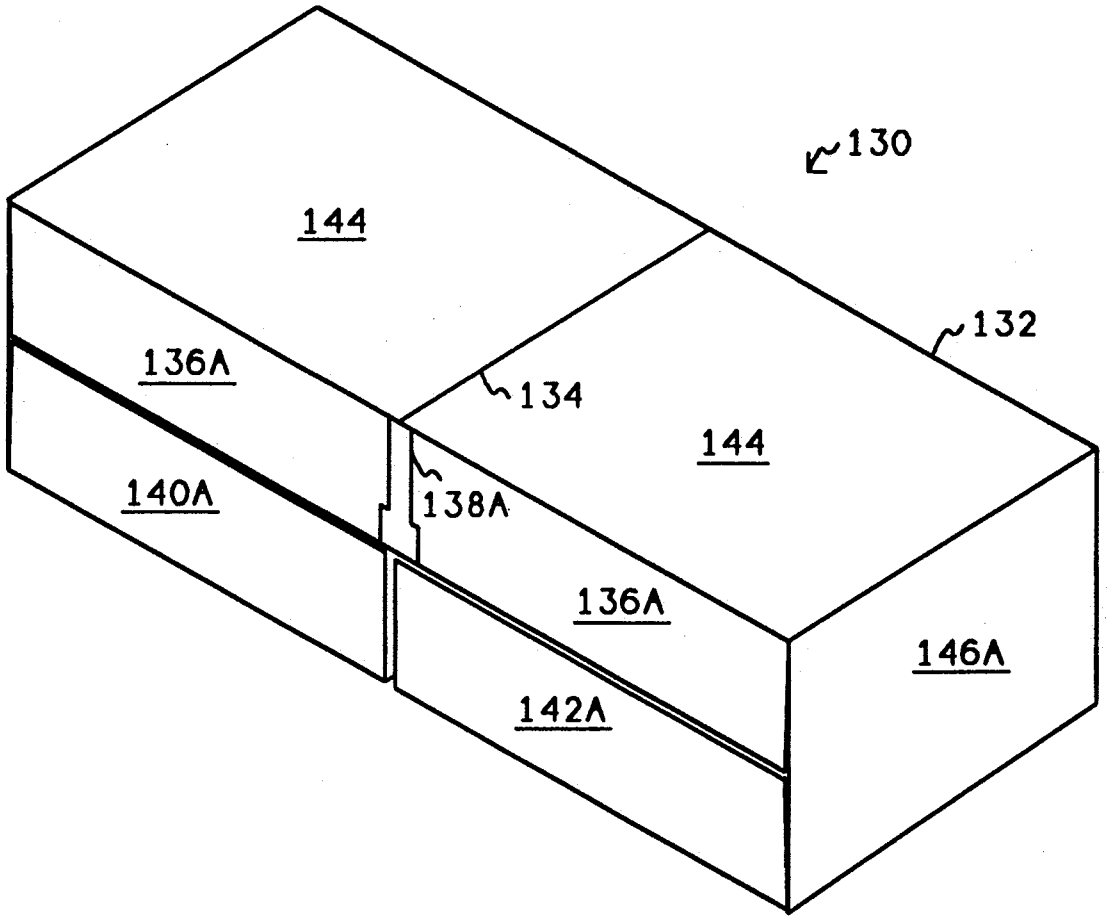
FIG. 12 shows an alternative embodiment of the invention containing tear-strips in side flaps.

FIG. 12 shows a perspective view of an alternative embodiment of the present invention wherein tear strips are located in side flaps. Referring now to FIG. 12, a package 130 is comprised of a one-piece wrapper 132 which wraps around and contains twenty-four cans or bottles (not shown), arranged as two twelve packs, each containing four rows of three cans or bottles. The wrapper 132 has a cut 134 in the package top 144. This cut could be replaced by a perforation in the top 144. A pair of tear-strips 138A and 138B (not shown in FIG. 12), located in flaps 136A and 136B (not shown in FIG. 12), allow the twenty four-pack to be split into two twelve-packs. Cut 134 need not extend completely across top 144, but preferably should extend far enough to weaken the line between tear-strips 138A and 138B so the package can be separated with relative ease. An important aspect of this package is that the flaps 136A and 136B are not separated at their centers, but instead, the tear-strips 138A and 138B (not shown in FIG. 12), located within the flaps 136A and 136B, are used to separate these flaps into two parts when the package is separated into two twelve packs.

Figure 13:
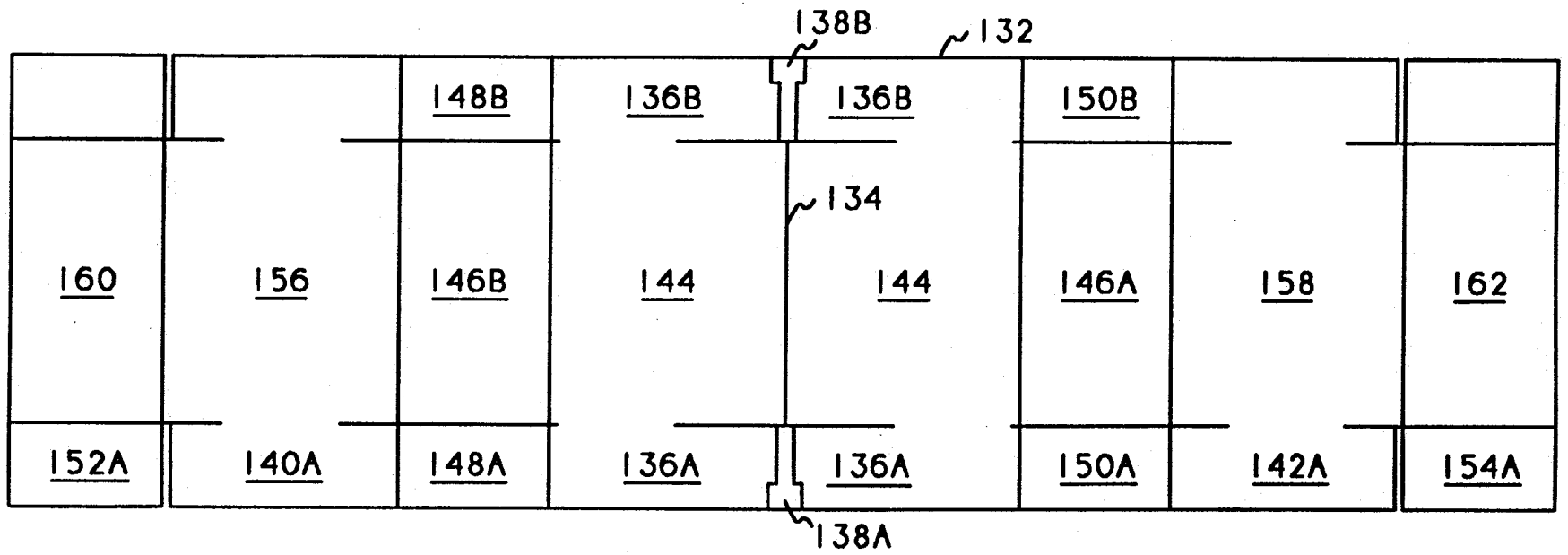
FIG. 13 shows a layout view of the wrapper of FIG. 12.

FIG. 13 shows a layout of the one-piece wrapper 132. Referring now to FIG. 13, the one-piece wrapper 132 includes the top 144 containing the cut 134. Attached to the top 144 are the flaps 136A and 136B containing the tear-strips 138A and 138B respectively. Extending outward from the top are end pieces 146A and 146B, each of which have flaps attached to them. Outward from the end pieces 146A and 146B are the two halves of the bottom 156 and 158. Attached to the two bottom halves 156 and 158 are the flaps 140A and 142A shown in FIG. 12. Outward from the bottom halves 156 and 158 are two divider halves 160 and 162.

Figure 14:
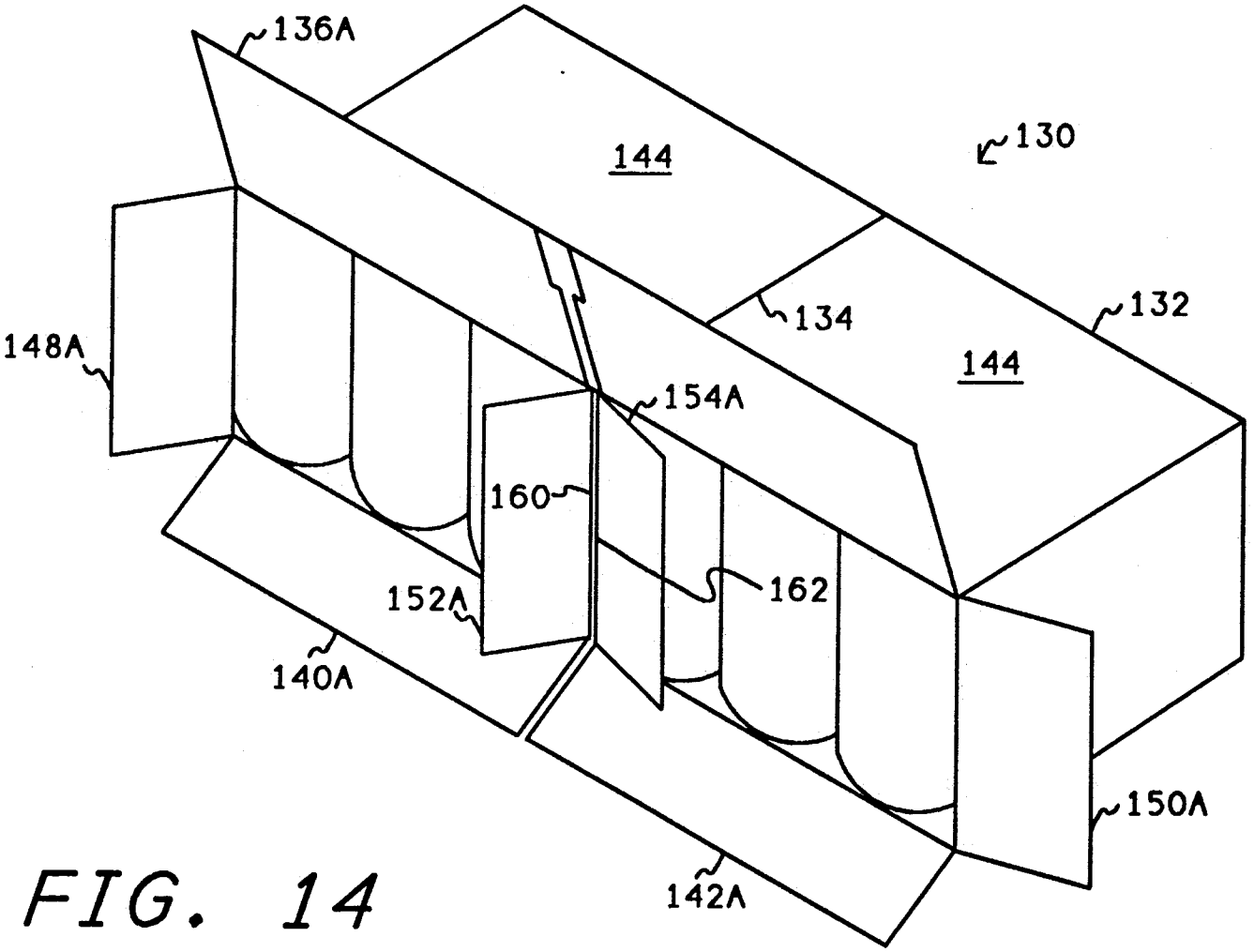
FIG. 14 shows a perspective view of the embodiment of FIG. 12 showing the flaps open.

FIG. 14 shows an end view of the package of FIGS. 12 and 13 and illustrates how the layout of FIG. 13 folds into the package 130. Referring now to FIG. 14, the top 144 is shown with the flap 136A folded upward. Flaps 148A and 150A are folded outward from end pieces 146B and 146A respectively. Divider halves 160 and 162 are shown abutting each other. The halves 160 and 162 could also be held together with glue (not shown).

Although not shown in the figures, the embodiment of FIG. 12 could be inverted with the cut being contained in the bottom, and the tear-strips in a side flap attached to the bottom.

Figure 15:
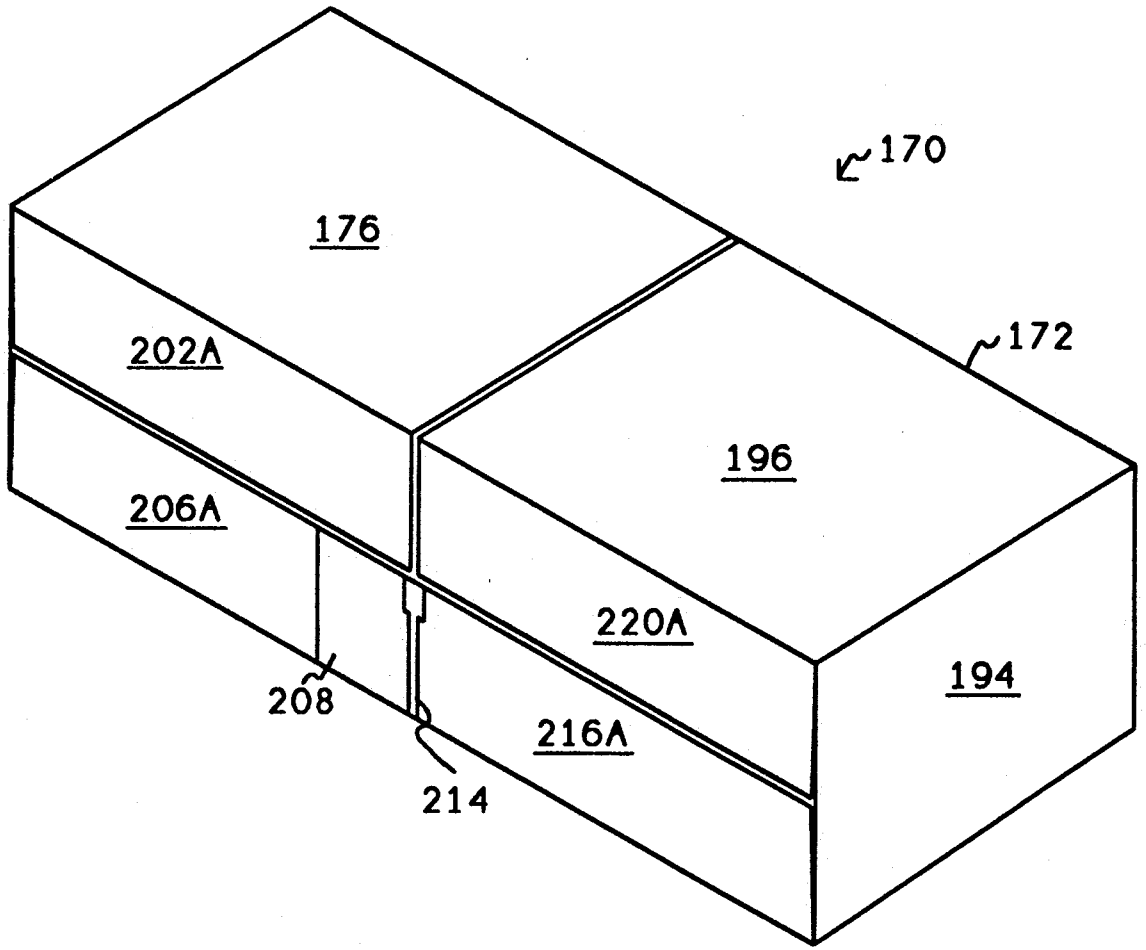
FIG. 15 shows another alternative embodiment of the invention containing glue flaps that overlap from one side of the package to the other.

FIG. 15 shows a perspective view of another alternative embodiment of the present invention wherein tear strips are located in side flaps. Referring now to FIG. 15, a package 170 is comprised of a one-piece wrapper 172 which wraps around and contains twenty-four cans or bottles (not shown), arranged as two twelve packs, each containing four rows of three cans or bottles. A pair of tear-strips 214 and 212 (not shown in FIG. 15), located in flaps 208 and 210 (not shown in FIG. 15), allow the twenty four-pack to be split into two twelve-packs. An important aspect of this package is that flaps 208 and 210 (not shown in FIG. 15) are formed as part of flaps 216A and 206B (not shown in FIG. 15) respectively. Flaps 208 and 210 are glued to flaps 206A and 216B (not shown in FIG. 15), respectively, to provide strength in holding the two twelve packs together. Tear strips 214 and 212 (not shown in FIG. 15) are used to separate the package into the two twelve packs.

Although not shown in the figures, the embodiment of FIG. 15 could be inverted with the glue flaps located at the top of the package. Also, the package is suitable for combining two six packs, or any other two containers.

Figure 16:
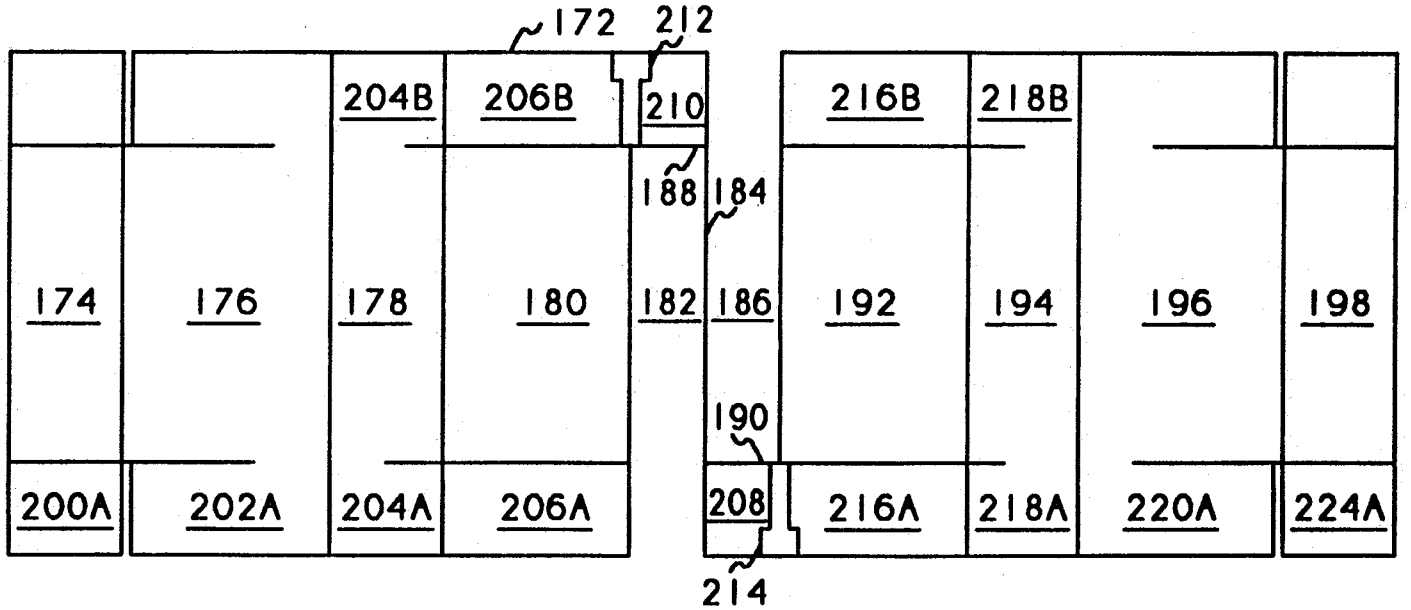
FIG. 16 shows a layout view of the wrapper of FIG. 15.

FIG. 16 shows a layout of the one-piece wrapper 172. Referring now to FIG. 16, the one-piece wrapper 172 includes a pair of center flaps 182 and 186 which are separated by a cut or perforation 184. The center flaps 182 and 186 fold together and form a divider between the two twelve packs. Attached to the center flaps 182 and 186 are the bottom pieces 180 and 192 respectively. Attached to the bottom piece 180 are end flaps 206A and 206B. Attached to the end flap 206B is a glue flap 210. A tear strip 212 is used to connect the glue flap 210 to the end flap 206B. A cut 188 separates the glue flap 210 from the center flap 182. Attached to the bottom piece 192 are end flaps 216A and 216B. Attached to the end flap 216A is a glue flap 208. A tear strip 214 is used to connect the glue flap 208 to the end flap 216A. A cut 190 separates the glue flap 208 from the center flap 186.

Extending outward from the bottom pieces 180 and 192 are end pieces 178 and 194, each of which have flaps attached to them. Outward from the end pieces 178 and 194 are the two halves of the top 176 and 196. Attached to the two top halves 176 and 196 are the flaps 202A and 220A shown in FIG. 15. Outward from the top halves 176 and 196 are two twelve pack divider halves 174 and 198.

Figure 17:
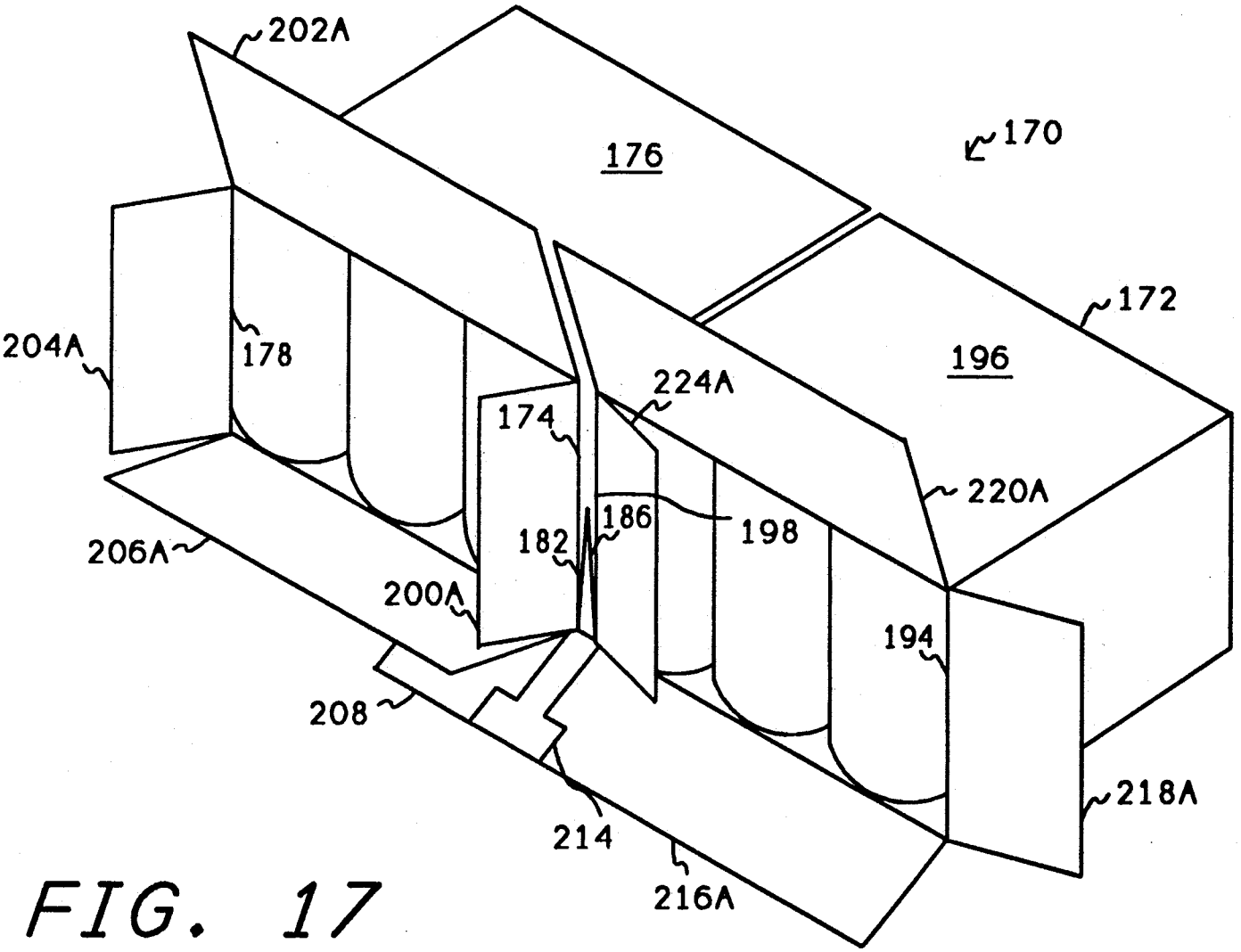
FIG. 17 shows a perspective view of the embodiment of FIG. 15 showing the flaps open.

FIG. 17 shows an end view of the package of FIGS. 15 and 16 and illustrates how the layout of FIG. 16 folds into the package 170. Referring now to FIG. 17, the top pieces 176 and 196 are shown with flaps 202A and 220A folded upward. Flaps 204A and 218A are folded outward from end pieces 178 and 194 respectively. Twelve pack divider halves 174 and 198 are shown abutting each other, and could be held together with glue (not shown). Glue flap 208 is shown adjacent flap 206A, and would be glued to flap 206A when the package is closed and sealed. Center flaps 182 and 186 are shown folded together between the two twelve packs.

Figure 18:
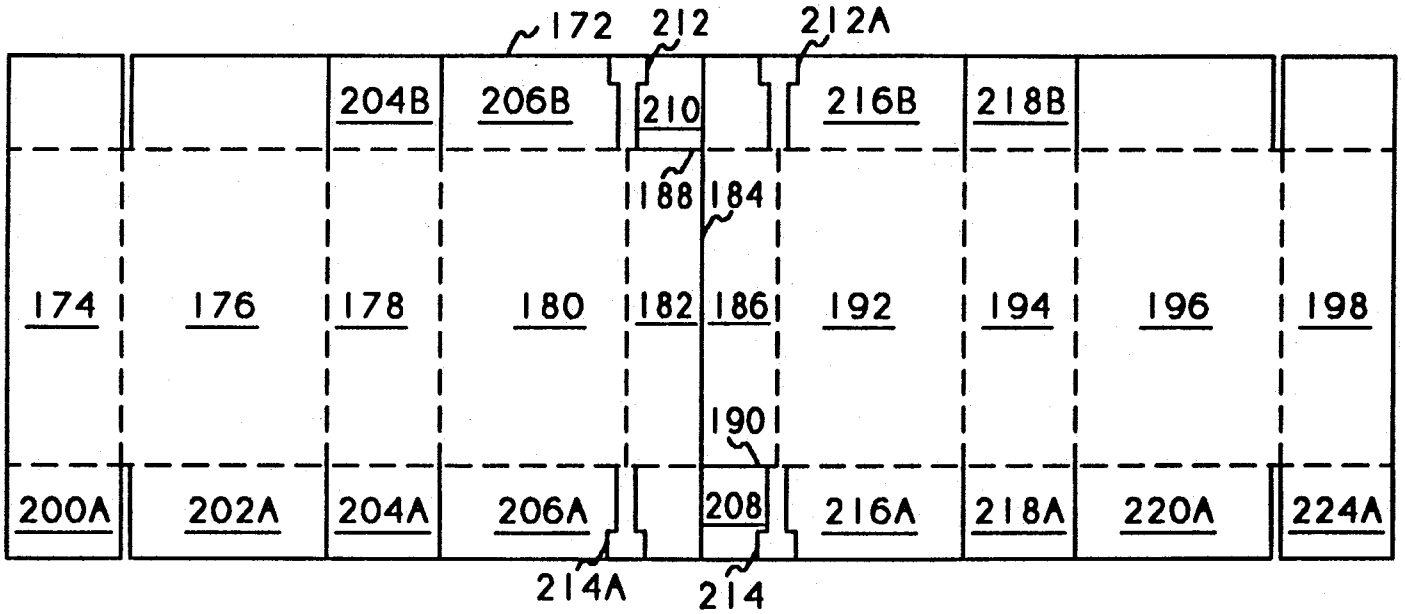
FIGS. 18 and 19 show an alternative embodiment of the package of FIGS. 15–17 having overlaping tear strips.
Figure 19:
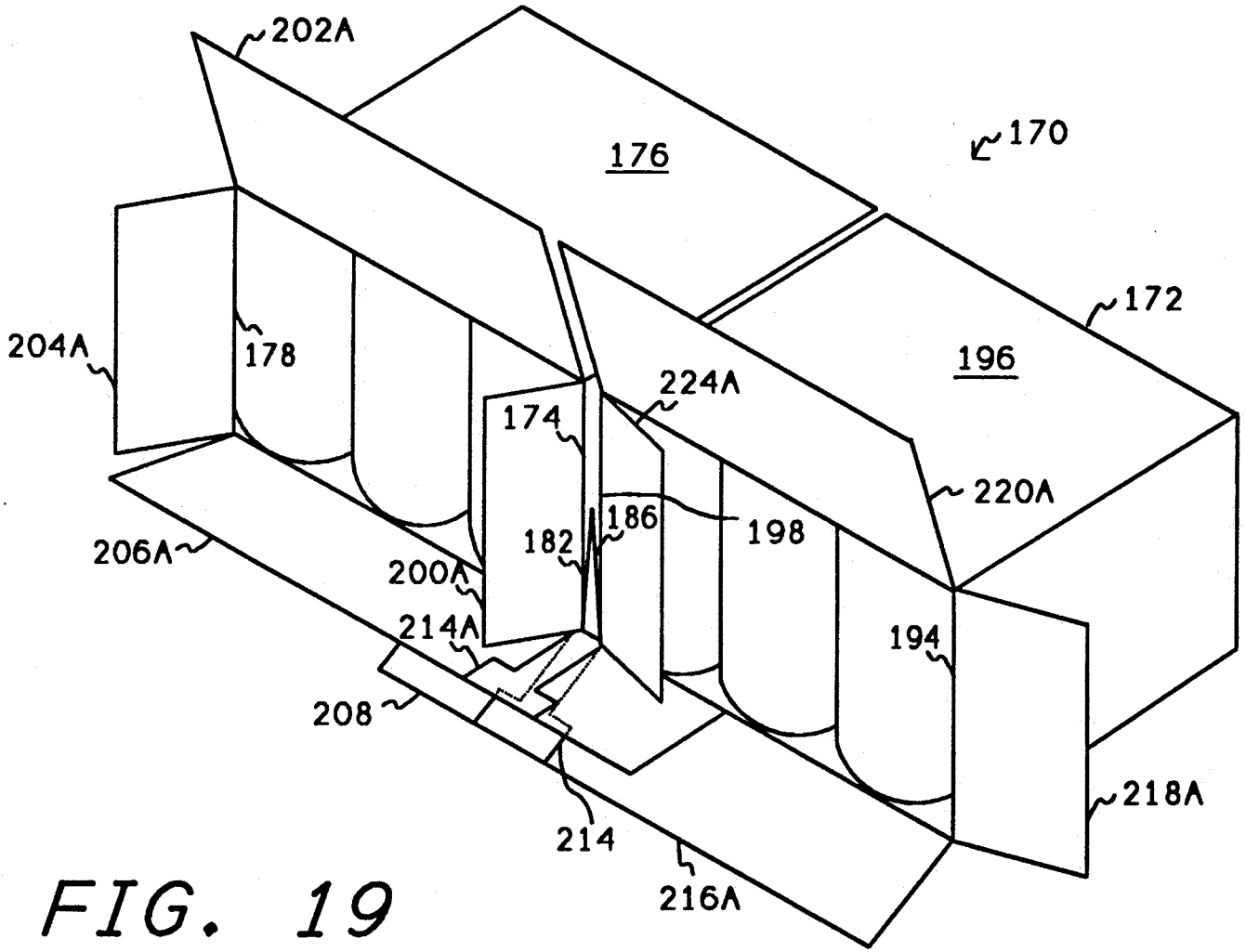

FIGS. 18 and 19 show an alternative embodiment to the package of FIGS. 15, 16, and 17. Referring now to FIGS. 18 and 19, flaps 206A and 216B have been extended to further overlap flaps 216A and 206B respectively, and tear strip 214A and 212A have been incorporated into the flaps 206A and 216B respectively. The extra amount of overlap provides for a stronger package. The tear strips 214A and 212A may align with the tear strips 214 and 212 respectively, as shown in FIG. 18, or they may be offset by a small amount in either direction. For example, any of the tear strips could be moved one-eighth of an inch to either side of the overlapping tear strip. Whether aligned or offset, however, each pair of overlapping tear strips can be pulled with the same motion.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the spirit and scope of the present invention. The disclosures and the description herein are intended to be illustrative and are not in any sense limiting of the invention, more preferably defined in scope by the following claims.

What is claimed is:

1. A package for holding a plurality of containers as a single unit, comprising:

a wrapper having a first divider half, a first package top connected to said first divider half, a first package side connected to said first package top, a first bottom half connected to said first package side, a first center flap connected to said first bottom half, a second center flap connected to said first center flap, a second bottom half connected to said second center flap, a second package side connected to said second bottom half, a second package top connected to said second package side, a second divider half connected to said second package top, and a wrap-around dimension extending from said first divider half around said sides, top, and bottom halves to said second divider half;

a first end flap connected to a first end of said first bottom half, said first end flap having a long dimension oriented parallel to said first package top;

a second end flap connected to a first end of said second bottom half, said flap having a long dimension oriented parallel to said first package top and having a length sufficient to allow said second end flap to overlap said first end flap;

a third end flap connected to a second end of said first bottom half, said third end flap having a long dimension oriented parallel to said first package top;

a fourth end flap connected to a second end of said second bottom half, said flap having a long dimension oriented parallel to said first package top and having a length sufficient to allow said fourth end flap to overlap said third end flap;

means for separation between said first and second center flaps; and a first tear strip located within said second end flap and a second tear strip located within said fourth end flap, said first and second tear strips oriented in a direction perpendicular to said wrap-around dimension and said first and second tear strips being located substantially at each end of said separation means.

2. The package of claim 1 further comprising:

a pair of flaps connected to each of said first and second package tops;

a pair of flaps connected to each of said first and second package sides; and a pair of flaps connected to each of said first and second divider halves.

3. The package of claim 1 wherein said separation means comprises a cut.

4. The package of claim 1 wherein said separation means comprises a perforation.

5. The package of claim 1 further comprising:

a third tear strip located within said first end flap and having a center located substantially in alignment with a center of said first tear strip; and a fourth tear strip located within said third end flap and having a center located substantially in alignment with a center of said second tear strip.

6. The package of claim 5 wherein all four tear strips have substantially the same width.

7. The package of claim 1 further comprising:

a third tear strip located within said first end flap and having a center located to be offset a predetermined amount from a center of said first tear strip; and a fourth tear strip located within said third end flap and having a center located to be offset a predetermined amount from a center of said second tear strip.

8. A package for holding a plurality of containers as a single unit, comprising:

a wrapper having a first divider half, a first package top connected to said first divider half, a first package side connected to said first package top, a first bottom half connected to said first package side, a first center flap connected to said first bottom half, a second center flap connected to said first center flap, a second bottom half connected to said second center flap, a second package side connected to said second bottom half, a second package top connected to said second package side, a second divider half connected to said second package top, and a wrap-around dimension extending from said first divider half around said sides, top, and bottom halves to said second divider half;

a first end flap connected to a first end of said first bottom half, said first end flap having a long dimension oriented parallel to said first package top and having a length sufficient to allow said first end flap to overlap said second bottom half;

a second end flap connected to a first end of said second bottom half, said flap having a long dimension oriented parallel to said first package top and having a length sufficient to allow said second end flap to overlap said first bottom half;

a third end flap connected to a second end of said first bottom half, said third end flap having a long dimension oriented parallel to said first package top and having a length sufficient to allow said first end flap to overlap said second bottom half;

a fourth end flap connected to a second end of said second bottom half, said flap having a long dimension oriented parallel to said first package top and having a length sufficient to allow said fourth end flap to overlap said first bottom flap;

means for separation between said first and second center flaps; and a first tear strip located within said first end flap, a second tear strip located within said second end flap, a third tear strip located within said third end flap, and a fourth tear strip located within said fourth end flap, all said tear strips oriented in a direction perpendicular to said wrap-around dimension and all said tear strips being located substantially at each end of said separation means.

9. The package of claim 8 further comprising:

a pair of flaps connected to each of said first and second package tops;

a pair of flaps connected to each of said first and second package sides; and a pair of flaps connected to each of said first and second divider halves.

10. The package of claim 8 wherein said separation means comprises a cut.

11. The package of claim 8 wherein said separation means comprises a perforation.

* * * * *